US005457471A

United States Patent [19]

Epperson, Jr.

[11] Patent Number: 5,457,471

[45] Date of Patent: Oct. 10, 1995

[54] ADAPTIVELY ABLATABLE RADOME

[75] Inventor: Edwin H. Epperson, Jr., Claremont, Calif.

[73] Assignee: Hughes Missile Systems Company, Los Angeles, Calif.

[21] Appl. No.: 648,433

[22] Filed: Sep. 10, 1984

[51] Int. Cl.[6] ..... H01Q 1/42

[52] U.S. Cl. ..... 343/872; 244/160; 250/515.1; 252/478

[58] Field of Search ..... 244/158 A, 117 A; 501/98; 250/515.1; 252/478; 343/872, 797

[56] References Cited

U.S. PATENT DOCUMENTS

| | | | |
|---|---|---|---|
| 2,281,637 | 5/1942 | Sukumlyn | 178/7.5 |
| 2,854,668 | 9/1958 | McMillan et al. | 343/872 |
| 2,962,717 | 11/1960 | Kofoid | 343/872 |
| 3,001,473 | 9/1961 | Shepheard | 102/49 |
| 3,002,190 | 9/1961 | Oleesky et al. | 343/907 |
| 3,063,654 | 11/1962 | Youngren et al. | 244/14 |
| 3,080,816 | 3/1963 | Levine | 102/50 |
| 3,195,138 | 7/1965 | Beck | 343/872 |
| 3,292,544 | 12/1966 | Caldwell et al. | 102/12.5 |
| 3,301,624 | 1/1967 | Morriss, Jr. | 350/52 |
| 3,302,884 | 2/1967 | Robinson | 239/265.15 |
| 3,596,604 | 8/1971 | Corkery | 102/105 |
| 3,762,666 | 10/1973 | Thompson | 244/3.19 |
| 3,925,783 | 12/1975 | Bleday et al. | 343/705 |
| 4,173,187 | 11/1979 | Steverding | 102/105 |
| 4,186,900 | 2/1980 | Loeb, Jr. | 244/113 |
| 4,304,870 | 12/1981 | Rice | 501/98 |

*Primary Examiner*—Donald P. Walsh

*Attorney, Agent, or Firm*—Charles D. Brown; Randall M. Heald; Wanda K. Denson-Low

[57] ABSTRACT

A radome useful with high-speed guided missiles has an inner conical shell made of a strong, high temperature resistant material transparent to radiant energy in the operative frequency range of a sensor mounted inside the shell. An outer ablative layer covers the exterior surface of the shell. This layer is made of a material which is also transparent to radiant energy in the sensor frequency range and which melts or sublimes and displaces from the shell at a predetermined elevated temperature and/or velocity during high-speed flight. The thickness of the ablative layer is selected so that it compensates for increased thickness and/or refraction resulting from thermal expansion of the shell, thereby minimizing guidance errors.

15 Claims, 1 Drawing Sheet

FIG. 1
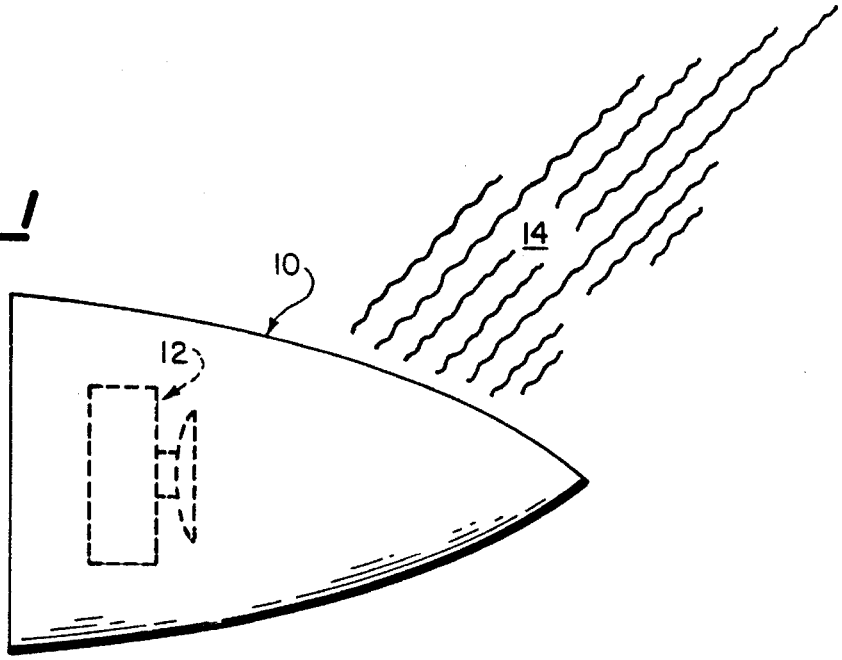
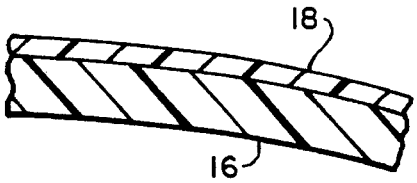
FIG. 2
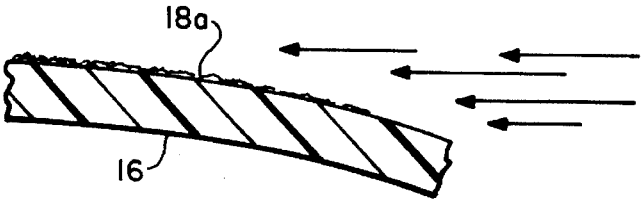
FIG. 3
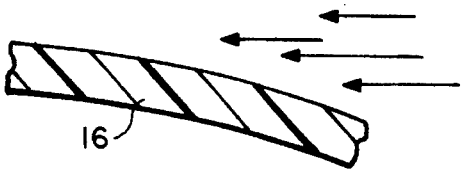
FIG. 4
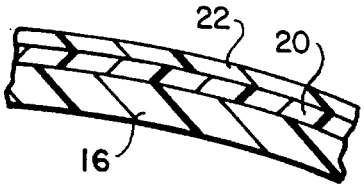
FIG. 5

ADAPTIVELY ABLATABLE RADOME

BACKGROUND OF THE INVENTION

The present invention relates to protective shields for radars and other sensors used in conjunction with guided airframes, and more particularly, to a radome useful with guided missiles and constructed to minimize guidance errors otherwise resulting from thermal expansion of the radome during flight.

A high speed guided missile employing an electromagnetic or other sensor for guidance requires a radome to cover the sensor. Typically, the radome is a conical or rounded hollow shell which encloses the sensor and provides the aerodynamically streamlined forward surface of the airframe. The radome must be transparent to radiant energy in the operative frequency range of the sensor. In addition, the radome must be rigid and heat resistant to withstand the rigors of high speed flight. Radomes have heretofore been constructed from a wide variety of materials such as ceramic material sold under the trademark PYROCERAM 9606 material.

Guidance errors are induced by refraction of the radiant energy as it passes through the radome into the interior thereof. These errors can be minimized by designing for a specific radome thickness. However, during high speed flight, the radome is heated as a result of the friction of the air passing over the radome at high speed and other sources of heat. Because the radome material has a temperature coefficient of expansion, a compromise must be obtained by adjusting the thickness of the radome for an average value over the expected temperature range of the radome in flight.

There are missile systems which use two or more configurations which, in turn, yield two or more ranges of temperatures during flight. In one configuration of interest, the radome temperatures range from about 390° F. to about 620° F. during flight, while in another configuration of interest, the same radome experiences a temperature range of only 250° F. to about 360° F. In a third configuration of interest, the same radome experiences a temperature range of about 360° F. to about 940° F. It would be desirable to use the same radome on the missile in all three configurations, however, this forces a performance compromise on the missile due to differing amounts of thermal expansion of the radome, and thus differing amounts of radiant energy refraction.

U.S. Pat. No. 3,001,473 discloses a rocket nose cone having multiple layers which burn away successively during re-entry into the earth's atmosphere to protect instruments or explosives at the forward end of the missile from excessive heat.

U.S. Pat. No. 3,292,544 discloses a radome having a layered or sandwiched configuration to provide low weight and/or wide frequency bandwith.

U.S. Pat. No. 3,762,666 discloses a radome having a solid cone tip coated with a ceramic or ablative material to divert air and foreign particles outwardly and prevent excessive heating or erosion of the remaining uncoated portion of the radome.

U.S. Pat. No. 3,925,783 discloses a tailored radome with variable thickness layers to minimize refractive distortion.

U.S. Pat. No. 4,173,187 discloses a multi-layer missile re-entry nose cone made of fused silica filled with radiation absorbing particles.

Also of general interest in this field are U.S. Pat. Nos. 2,281,637; 2,854,668; 2,962,717; 3,002,190; 3,063,654; 3,080,816; 3,195,138; 3,301,624; 3,302,884; 3,596,604; and 4,186,900.

SUMMARY OF THE INVENTION

Accordingly, it is the primary object of the present invention to extend the useable temperature and/or velocity range of a guided missile by adaptively controlling the radome thickness during flight.

Another object of the present invention is to provide a novel radome that minimizes variations in radiant energy refraction normally resulting from thermal expansion of the radome.

According to the present invention, a novel radome is provided having an inner hollow shell made of a first material substantially transparent to radiation in a predetermined frequency range and capable of maintaining structural integrity when heated to a temperature in a predetermined elevated temperature range. An outer ablative layer of a second material covers the exterior surface of the shell and is also substantially transparent to radiation in the predetermined frequency range. The second material loses its structural integrity and displaces from the shell when heated to a temperature in the predetermined elevated temperature range and impacted with gas at a predetermined velocity. The thickness of the ablative layer is selected to minimize variations in the refraction of the radiation passing through the shell that would otherwise result from thermal expansion of the shell when heated to a temperature in the predetermined elevated temperature range. Preferably the ablative layer displaces from the shell during flight prior to the period of time when the sensor enclosed by the radome is operative to provide accurate guidance. In an alternate embodiment of my invention, multiple adaptively ablatable layers may be applied over the inner shell where tighter control of effective radome thickness versus temperature is needed or where a wider temperature environment is to be encountered.

BRIEF DESCRIPTION OF THE DRAWINGS

FIG. 1 is a simplified elevation view of the first embodiment of my radome showing a sensor in phantom lines enclosed within the radome. Radiant energy in the operative frequency of the sensor is illustrated schematically before passing through the radome for reception by the sensor.

FIG. 2 is a greatly enlarged, fragmentary sectional view of the first embodiment of my invention.

FIG. 3 is a view similar to FIG. 2 and illustrating the melting and displacement of the ablative layer from the inner shell of the radome during high speed flight.

FIG. 4 is a view similar to FIG. 3 illustrating the substantial removal of the ablative layer from the shell during flight.

FIG. 5 is an enlarged, fragmentary sectional view illustrating the second embodiment of my radome which has multiple ablative layers.

The dimensions in FIGS. 2–5 are not to scale.

DESCRIPTION OF THE PREFERRED EMBODIMENTS

Referring to FIG. 1, the first embodiment 10 of my radome is adapted for use with a high-speed guided missile or other airframe (not illustrated) having an onboard sensor such as a gimbal mounted scanning dish antenna 12. The radome preferably has an aerodynamically streamlined shape since it is mounted at the forward end of the airframe. The radome 10 illustrated in FIG. 1 has a generally conical shape with the cone sides being slightly convex. Other shapes may be utilized with the present invention, such as hemispherical or any other shape configured so that air can impact and remove the softened ablative outer layer of the radome as hereafter described.

The sensor 12 is of the electromagnetic type adapted to receive radiant energy in the form of electromagnetic waves 14. The electromagnetic waves 14 may be in the RF band or some other frequency, depending upon the type of sensor dictated by the tactical requirements of the missile. Other types of radiant energy sensors may be utilized, such as infrared.

Clearly the radome must be substantially transparent to the operative frequency range of the sensor housed within it. Referring to FIG. 2, the radome 10 includes an inner hollow conical shell 16. Besides being transparent to radiation at the sensor frequency, the shell material must also be strong enough to withstand the rigors of high speed flight. Furthermore, for reasons which will become hereafter apparent, the shell material must be resistant to high temperatures. The shell 16 may be made of any of the conventional radome materials such as PYROCERAM 9606 material or composite materials. Preferably, the shell material can withstand temperatures up to 940° F. or higher, depending on application, without losing structural integrity.

When the radome 10 is heated during high speed flight, the shell 16 expands. The primary effect of this expansion is to increase the amount of refraction of the radiant energy passing through the shell into the interior of the radome. Expansion of the shell may also vary the amount of attenuation or phase of the radiant energy passing through the shell. Thus, the variations in the radiant energy transmission characteristics of the shell which occur when the shell is heated can produce guidance errors. These errors can reduce the accuracy of the missile and increase the chance that it will miss the target.

My invention provides a novel solution to this dilemma. According to my invention, the very factor, namely elevated temperature, which causes the radome thickness to increase, is used to adaptively ablate a thin dielectric covering, implanted on the radome prior to installation on the missile. The ablation occurs on the higher temperature flights prior to the period of time when accurate guidance is required. During low temperature flights, the dielectric ablative layer remains in place. Referring to FIG. 2, the ablative layer 18 overlies the inner shell 16 and is preferably bonded directly thereto. The ablative layer may cover the entire exterior surface of the shell 16. Alternatively, the ablative layer 18 may cover that portion of the shell through which the radiant energy will pass before being received by the sensor 12. In FIG. 1 the ablative layer would have to cover that portion of the shell extending forward from the scanning dish of the sensor. The thicknesses of the ablative layer 18 and the shell 16 are selected to yield optimal thicknesses 1) during high temperature flights without the presence of the ablative layer, and 2) during low temperature flights with the ablative layer. Of course the ablative layer must be made of a material which is also substantially transparent to radiant energy in the operative frequency range of the sensor. However, whereas the shell 16 is made of a heat resistant material, the ablative layer 18 is preferably made of a material which loses its structural integrity and is displaced off of the shell at a predetermined elevated temperature just prior to the time when accurate guidance commands must be generated from the sensor 12.

The missile is adapted to be used in three configurations, the first in which the radome experiences a temperature range of only about 250° F. to about 360° F., the second in which the radome experiences a temperature range from about 390° F. to about 620° F., and a third configuration in which the radome experiences a temperature range of about 360° F. to about 940° F. In this example, an ideal ablation temperature would be about 360° F. A slightly higher temperature would also suffice, since temperatures will generally exceed the minimum stated values later in flight, where accurate guidance is required. For the example cited above, a dielectric ablative layer of approximately 0.001 inches having a relative dielectric coefficient of between about 5.0 and 6.0 is desired.

Dielectrics which may be used as the ablative layer to satisfy the above requirements exist in various forms. For example one suitable material is oil based enamel paint containing xylene which is manufactured by Borden and sold as an aerosol spray paint under the registered trademark KRYLON. This paint has an ablation temperature of about 365° F. The thin ablative layer may be applied to the shell to achieve a uniform thickness. When the radome temperature exceeds about 365° F., the ablative layer 18 melts as illustrated at 18*a* in FIG. 3. The high pressure air impacting the radome forces a rapid ablation of the material off of the shell leaving the uncovered shell 16 as illustrated in FIG. 4. The high pressure air is illustrated by the arrows in FIGS. 3 and 4. Preferably the complete ablation should occur before the time when the radome thickness is critical with respect to the sensor 12.

A number of factors must be borne in mind in selecting an appropriate material for the ablative layer 18. The material must begin to soften in the above example, just prior to 360° F. and be able to withstand the atmospheric conditions that it will be subjected to, either in storage, or in flight before the critical temperature is reached. Most materials that soften at about 360° F. were found to be either organics or salts. The organics when heated above 360° F. will leave a carbon residue on the shell which will greatly affect the transmission characteristics of the remaining radome. The salts will not withstand the expected environmental conditions. Certain paints offered the promise of withstanding the environmental conditions and not leaving a residue on the shell. One such paint I discovered was white KRYLON spray paint in an aerosol can.

In order to verify the utility of my invention, I sprayed a three-by-five inch sheet of aluminum with several coats of white KRYLON spray paint. I then heated the coated aluminum sheet to approximately 400° F. while monitoring the softening and relative viscosity of the paint layer. I noted that at 350° F. the paint layer started to soften and by 390° F. it was completely liquified.

Since the softening temperature of the paint layer looked promising, I investigated the dielectric constant of the paint. To do this, I sprayed several coats of white KRYLON on a 5¾ inch by 4 inch sheet of aluminum. I then sandwiched the painted aluminum between other aluminum sheets to form a capacitor. The governing equation for the dielectric constant is: $CL/E_oA$, where C is the capacitance in Farads, L is the thickness of the paint in meters (which was measured to be 0.006 inches which equals $1.524[10^{-4}]$ meters) $E_o$ equals $8.85(10^{-12})$F/m, and A is the area of the plates which equaled 0.0148 square meters. A capacitance meter was used to measure the capacitance which was found to be almost exactly 5,000 pf.

Substituting into the above equation and solving for K yielded K=5.82, which is a reasonable value for X-band transmittance.

I performed a final test to see how easily the KRYLON paint could be applied to a radome and how it reacted to temperature. In order to do this, I obtained a commercial, conical radome with curved, convex sides. I painted the radome with the KRYLON spray paint on a rotating pedestal until a sufficient coating was applied. I later measured the thickness of the paint layer and it ranged from 0.001 inches at the base of the conical radome to approximately 0.002 inches at the apex of the radome.

I placed the painted radome in a furnace with a thermocouple attached to the surface and I heated the painted radome up as quickly as possible to approximately 370° F. An air hose was positioned to discharge air at approximately 100 psi over the heated surface of the heated radome. Table I below sets forth the effects that occurred as the temperature increased.

| Temperature °F. (with air) | Effects |
|---|---|
| 200 | No effect |
| 220 | No effect |
| 240 | No effect |
| 260 | No effect |
| 280 | No effect |
| 300 | No effect |
| 320 | No effect |
| 330 | Sticky but still solid |
| 340 | Sticky but still solid |
| 345 | Softer but no pressure effect |
| 350 | Softer but no pressure effect |
| 355 | Very slight pressure effect |
| 360 | Greater pressure effect |
| 365 | Greater pressure effect |
| 370 | Pressure cleans surface |

By examining Table I above it is clear that the ablative layer in the form of paint began to soften at approximately 345° F. However, at that temperature the paint was still not soft enough for removal with high pressure air. At approximately 370° F., the air removed the paint easily. Therefore, between these two temperatures the paint would be removed from the underlying radome shell at the appropriate rate. Thus, the same thing would occur if the radome were flying at high speed and the same temperatures were generated in the radome.

Accordingly, my invention provides in-flight adaptability of the ablative radome material. Specifically, one radome design will suffice for low speed applications where the ablative material remains on the composite underlying radome shell and for high speed applications where the ablative material melts, sublimates, or softens to the point where the ablative layer is displaced by the force of the surrounding air pressure from the composite radome shell. This ablation compensates for the increased thickness and/or refraction, or other alteration of the transmission properties of the shell due to the affects of high velocity heating.

The radome described in the example above was tested in an RF darkroom before and after application of the ablative layer to satisfactorily verify transmission and refraction specifications.

While I have described the preferred embodiment of my invention in considerable detail, it will be apparent that adaptations and modifications thereof will occur to those skilled in the art. For example, multiple adaptively ablatable layers 20 and 22 (FIG. 5) may be applied to the underlying shell 16. This may be done where tighter control of effective radome thickness versus temperature is needed or where a temperature environment is to be encountered. Therefore, the protection afforded my invention should only be limited in accordance with the scope of the following claims.

I claim:

1. A radome comprising:

an inner hollow shell made of a ceramic material substantially transparent to electromagnetic radiation in a predetermined frequency range and capable of maintaining structural integrity when heated to a temperature in a predetermined elevated temperature range; and an outer ablative layer of a dielectric material overlying at least a portion of the exterior surface of the shell, the dielectric material also being substantially transparent to radiation in the predetermined frequency range, the dielectric material losing its structural integrity and displacing from the shell when heated to a temperature in the predetermined elevated temperature range and impacted with gas at a predetermined velocity, the thickness of the ablative layer being selected to minimize variations in the refraction of the radiation passing through the shell into the interior thereof that would otherwise result from thermal expansion of the shell when heated to a temperature in the predetermined elevated temperature range.

2. A radome according to claim 1 wherein the shell has an aerodynamically streamlined configuration.

3. A radome according to claim 1 wherein the ablative layer is about 0.001 inches thick and has a relative dielectric coefficient of between about 5.0 to 6.0.

4. A radome according to claim 1 wherein the ablative layer has a uniform thickness over the entire exterior surface of the shell.

5. A radome according to claim 1 wherein the predetermined elevated temperature range covers temperatures from about 390° F. to about 620° F.

6. A radome according to claim 1 wherein the predetermined elevated temperature range covers temperatures from about 250° F. to 360° F.

7. A radome according to claim 1 wherein the predetermined elevated temperature range covers temperatures from about 360° F. to 940° F.

8. A radome according to claim 1 wherein the predetermined elevated temperature range covers temperatures from about 360° F. to 365° F.

9. A radome according to claim 1 wherein the predetermined elevated temperature range covers temperatures above 300° F.

10. A radome according to claim 1 wherein the ablative layer has a non-uniform thickness.

11. A radome according to claim 1 wherein the shell has a generally conical shape and the thickness of the ablative layer varies between the apex and the base of the shell.

12. A radome according to claim 1 wherein the predetermined frequency range includes the X-band.

13. A radome according to claim 1 wherein the dielectric material does not leave a carbon residue on the shell when it is heated and displaced.

14. A radome for shielding the sensor of a guided missile comprising:

a hollow shell made of a strong, heat resistant material substantially transparent to electromagnetic radiant energy in a predetermined operative frequency range of the sensor, the heat resistant material being selected from the group consisting of ceramic material and composite material; and an outer ablative layer covering at least the portion of the exterior surface of the shell through which the radiant energy will pass before being received by the sensor, the ablative layer being made of a dielectric material which is also substantially transparent to radiant energy in the predetermined frequency range, the dielectric material normally being solid at ambient temperatures but softening and displacing from the shell when heated to a predetermined temperature and impacted by air at a predetermined velocity, the thickness of the ablative layer being selected to minimize guidance errors otherwise induced by variations in the radiant energy transmission characteristics of the shell when heated to the predetermined elevated temperature.

15. A radome comprising:

an inner hollow shell made of a material substantially transparent to electromagnetic radiant energy in a predetermined frequency range and capable of maintaining structural integrity when heated to a temperature in a predetermined elevated temperature range, said material being selected from the group consisting of ceramic material and composite material;

an inner ablative layer of a first dielectric material overlying the exterior surface of the shell;

an outer ablative layer of a second dielectric material overlying the inner ablative layer;

the first and second dielectric materials being substantially transparent to radiant energy in the predetermined frequency range;

the outer ablative layer displacing from the inner ablative layer when heated to a first lower portion of elevated temperature range and impacted with gas at a first predetermined velocity;

the inner ablative layer displacing from the shell when heated to a second upper portion of the elevated temperature range and impacted with gas at a second predetermined velocity; and the thicknesses of the ablative layers being selected to reduce variations in the refraction of radiation passing through the radome into the interior thereof that would otherwise result from thermal expansion of the radome when heated to temperatures in the first and second portions of the predetermined elevated temperature range.

* * * * *